United States Patent [19]

Jenkins et al.

[11] 4,064,810

[45] Dec. 27, 1977

[54] RAILWAY CAR DOOR ACTUATING APPARATUS

[75] Inventors: Oliver James Jenkins; Walter Samuel Ryan, both of Youngstown; Leslie David Suit, Girard, all of Ohio

[73] Assignee: The Youngstown Steel Door Company, Cleveland, Ohio

[21] Appl. No.: 625,490

[22] Filed: Oct. 24, 1975

[51] Int. Cl.[2] ..... B61D 17/08; B61D 17/18; B61D 19/00; E05D 15/10

[52] U.S. Cl. ..... 105/378; 49/220; 105/409; 105/423

[58] Field of Search ..... 49/218, 219, 220; 105/378, 409, 423

[56] References Cited

U.S. PATENT DOCUMENTS

| | | | |
|---|---|---|---|
| 2,628,389 | 2/1953 | Madland | 49/220 |
| 2,658,244 | 11/1953 | Madland | 49/220 |
| 2,747,239 | 5/1956 | Soddy | 49/220 |
| 3,199,261 | 8/1965 | Soddy | 105/378 X |
| 3,216,067 | 11/1965 | Bailey | 105/378 X |
| 3,747,270 | 7/1973 | Ross, Jr. et al. | 49/220 |
| 3,853,071 | 12/1974 | Snyder et al. | 105/409 |

*Primary Examiner*—Robert J. Spar
*Assistant Examiner*—Howard Beltran
*Attorney, Agent, or Firm*—John H. Mulholland

[57] ABSTRACT

A railway car door includes an operating mechanism having a pair of pipes and cranks rotatably secured to the door. By their rotation, the door is movable into and out of a door opening. The car is equipped to have internally-projecting lading restraining members removably attached to the inside car sidewall and filler members removably attached to the inside of the door. Pipe stops are provided for selectively increasing or decreasing the amount of rotation of the pipes and cranks possible so that when the filler members are attached to the door, the door can be moved laterally out of the opening a first greater distance and thereby permit the filler members to clear the sidewall or adjacent door of the car. When the filler members are removed, the door can be moved a second, lesser distance out of the opening and clear of the sidewall or adjacent door of the car. Adjustable door stops are provided for positioning a door and for protecting the door and a second car door, which may be adjacent thereto, from damage by impact with each other. The door stop is adjustable between a first position, in which the door stop member protects the doors from damage by impact with each other when an adjacent door is moved out of its opening the first greater distance, and a second position in which it is stored until next needed for protection of the doors from impact.

7 Claims, 13 Drawing Figures

RAILWAY CAR DOOR ACTUATING APPARATUS

BACKGROUND OF THE INVENTION

This application is directed to railway car doors and more particularly, to railway car doors for use with removable filler members.

The prior art shows various systems for retaining cargo in a railway car depending on the type of cargo loaded in the railway car. One such system utilizes straps having their opposing ends anchored to opposing car sides and extending across the railway car to restrain movement of cargo in the railway car. The prior art has disclosed means for securing the opposing ends of the straps to opposing railway car sides which securement means are flush with the railway car sides to maximize the interior space of the car.

Another cargo restraining system of the prior art includes the use of rigid cargo restraining bars which have opposing ends removably secured to opposing sides of the railway car to thereby restrain movement of cargo in the car.

The prior art has disclosed the use of both cargo restraining systems in one car. For example, Synder, et al, U.S. Pat. No. 3,853,071, shows a cargo restraining device which provides various cargo or lading restraining members attached to the sides of the railway car and extending interiorly thereof. Rigid cargo restraining bars are removably secured to the cargo restraining members and extend between opposing sides of the railway car. The cargo restraining members to which the rigid cargo restraining bar is attached extend interiorly of the sides of the railway car and decrease the distance between both sides of the car. The cargo restraining members are removable when desired and thereby the effective width of the railway car between the opposing sides can be increased. The Snyder patent also provides means for securing the opposing ends of cargo restraining straps to the opposing sides of the railway car when the cargo restraining members are removed.

When the effective distance between the opposing sides of a railway car is decreased by the attachment of removable cargo restraining members, the cargo loaded on the railway car adjacent to the railway car door must be restrained from moving laterally against the railway car door. Accordingly, the distance between the railway car door and its opposing door or side must be effectively reduced by the same distance as the distance between the cargo restraining members secured to the opposing sides of the railway car. On the other hand, when the cargo restraining members are removed and the effective cargo distance between the opposing sides of the railway car is increased, it is desirable for the distance between the railway car door and its opposing door or side to be substantially the same as the distance between the opposing sides of the railway car to uniformly increase the space in which cargo may be carried.

The conventional railway plug door is adapted to be received in a door opening with the door being removable, in sequence, both laterally and longitudinally of the car. Gaskets are ordinarily provided around at least a portion of the periphery of the door and are adapted to be compressed against the frame of the door opening thereby to seal the opening.

The amount of lateral movement of the conventional railway plug door is sufficient, when the door is closed, to compress the gasket to seal the opening and, when the door is opened, to allow the door to clear the side wall of the railway car and thereby permit movement of the door longitudinally with respect to the car.

A typical operating mechanism for opening and closing a plug door includes a clevis attached to each of two pipes and a rod attached to each of the clevises. The rods are caused to reciprocate relative to the center of the door, thereby rotating the pipes. The rods are connected for reciprocation to a driven gear segment which is remotely actuated by a pinion rotationally connected to a handle. This rotating handle is the manually controlled mechanism for withdrawing the plug door from the door opening to permit it to move longitudinally along the car parallel to the car side wall or to laterally insert it in the opening. To minimize the time and effort necessary to open the door, the clearance between the door and the car side, when the door is opened, is maintained at a minimum. Accordingly, it is desirable to move the door a second, lesser distance in the lateral direction out of the opening when means for decreasing the effective distance between the railway car door and its opposing sides such as filler members, are not attached to the door and correspondingly a first, greater distance when such filler members are attached to the door. In addition, it is desirable to provide filler members which may be easily secured or removed from the door with conventional fasteners using standard wrenches.

When the door is movable laterally into and out of the opening in the side of the car, different distance, it is desirable that stop means be provided to prevent damage to the railway door by impact with adjacent members of the car. It is desirable to have a stop means which is adjustable to prevent damage to the door when it is either a lesser or greater lateral distance from the door opening and capable of positioning the door adjacent the opening.

This invention provides the desirable features described above by providing a railway car door having filler members which are removably attached to the inside of the door. The filler members project into the car by an amount substantially the same as the internal projection of the cargo restraining members. When the cargo restraining members are removed, the filler members may be removed. This invention provides means for selectively increasing the amount of rotation of pipes and cracks on the door. Thus, when the filler members are attached to the door, the pipes and cracks can move a greater rotational distance which allows the door to move a greater distance laterally out of the opening to clear the side wall. Alternatively, when the filler members are not attached to the door, the pipes and cracks can move a lesser rotational distance which is sufficient to move the door a lesser distance laterally out of the opening to clear the side wall. This invention also provides adjustable door stop means which protects the door from damage by impact with other doors or adjacent car structural members and is adjustable to compensate for the distance, whether greater or lesser as described above, which the door is moved laterally into or out of the opening in the car.

BRIEF DESCRIPTION OF THE INVENTION

This invention relates to railway car doors and more particularly, to railway car doors for use with removable filler members. The railway car door is mounted on cranks which are fixed to vertically extending, rotatable pipes attached to the car door on the outer side thereof. An operating mechanism is provided for rotating the pipes and cranks and includes a shaft rotatably supported on the door with activating means secured to the shaft. A transmission means is provided which is supported on the door interconnecting the operating mechanism with the pipes and cranks. Upon rotations of the shaft, in response to operation of the activating means or handle, a corresponding rotation is imparted to the cranks and pipes to provide selective lateral movement of the door into and out of an opening in the side or a railway car.

The railway car is equipped to have internally projecting lading restraining members selectively attached and removed from the inside of the railway car side wall adjacent to the opening. Filler members or rub rails are provided which are removably attached to the door.

The filler members project into the car by an amount substantially equal to the internal projection of the lading restraining members. Means are provided for selectively increasing or decreasing the amount of rotation of the pipes and cranks possible. When the filler members are attached to the inside of the door, the pipes and cranks can move a greater rotational distance to consequently move the door laterally out of the opening a greater distance and thereby permit the filler members to clear the side wall of the railway car. When the filler members are removed, the cranks are permitted to rotationally move a lesser distance to consequently move the door, a lesser distance laterally out of the opening and clear the side wall of the railway car.

Adjustable door stop means are also provided for protecting the railway car door from damage by impact with other railway car structural members such as a second, adjacent railway car door. The adjustable door stop means includes an adjustable door stop member selectively secured to the door in a first position or a second position. In the first position, the adjustable door stop member protects the doors from damage by impact with each other when the second, adjacent door is positioned laterally out of the opening a first, greater distance, while allowing the second, adjacent door to move along the side wall in a direction away from the other door. In the second position, in which the adjustable stop member is in an inverted position with respect to its first position, the adjustable door stop member protects the doors from damage by impact with each other when the second, adjacent door is positioned laterally out of the opening a second, lesser distance while allowing movement of the second, adjacent door along the side wall in a directon away from the other door. The stop member is also capable of positioning the second, adjacent door adjacent the portion of the opening that the second, adjacent door covers when in the closed position.

DESCRIPTION OF THE PREFERRED EMBODIMENT

Figure 1:
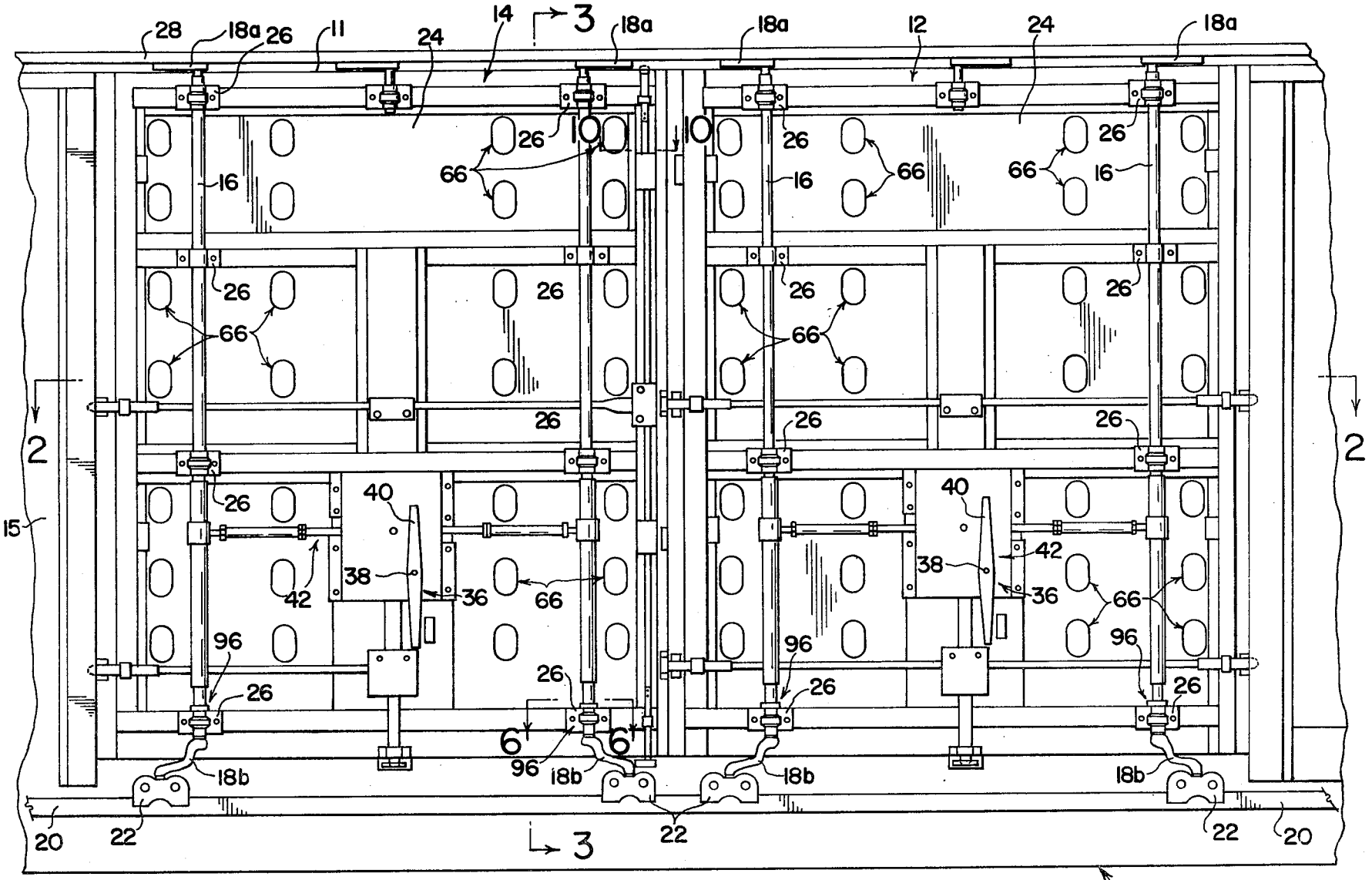
FIG. 1 is a front elevational view of a main and auxiliary railway car doors embodying the present invention in their closed positions.

This invention is concerned with railway car doors and more particularly, railway car doors having removable rub rails or filler members for use with lading restraining "or damage free" systems. In FIG. 1, one such railway car used with the doors of the present invention is generally indicated by the numeral 10. Disposed in an opening 11 in a side 15 is a main car door 12 and an auxiliary car door 14. Each of the doors are supported by a pair of pipes 16 and upper and lower cranks 18*a* and 18*b*, respectively, attached to the ends of the pipes 16. Each of the doors 12, 14 are adapted to move laterally out of the door opening 11 and move longitudinally along the side of the car 10 on a track 20 to free the door opening for loading and unloading. As seen in FIG. 1, the cranks 18*a* and 18*b* serve as lever arms for laterally moving the doors 12, 14 in and out of the door opening 11. The door is movably supported on the track 20 by roller hangers 22 which are attached to the ends of the lower cranks 18*b* to guide the door on its longitudinal movement. The pipe 16 are rotatably secured to the outer faces 24 of the doors 12, 14 by brackets 26 located near the side edge of each of the doors 12, 14 to hold the pipes 16 in a vertical position. The upper cranks 18*a* are attached at one of their ends to the upper end of their respective pipes 16 and have a roller at their opposite ends. These rollers are disposed behind a retainer rail 28. The combination of these rollers and the retainer rail 28 acts to retain the top of car doors 12, 14 as they are moved longitudinally along the track 20.

It should be understood that since the main and auxiliary doors, 12, 14 respectively, individually close only a portion of the opening 11; terms such as "opening in the side of the railway car 10" may be used to define a portion of the opening 11 that only one of the doors 12, 14 is used to close and a portion of that opening 11 will be defined by a portion of the other door.

The main door 12 has a sealing surface 30 which extends about the periphery of the main door. The sealing surface 30 is defined by a compression gasket 34 which is secured to the periphery of the main door 12. The auxiliary door 14 has a sealing surface 32 which extends about the periphery of the auxiliary door. The sealing surface 32 is defined by a compression gasket 34 which extends around three sides of the door 14 and a flat surface 32*a* on the periphery of the other side of the auxiliary door. The opening 11 in the side wall 15 has a sealing surface 33 adjacent to the opening which surface is defined by two substantially parallel vertical surfaces 33*a* as shown in FIG. 2 and two substantially horizontal surfaces 33*b* on the header 35*a* and plate 35*b* on the car side 15 as seen in FIG. 3.

When the auxiliary door 14 is closed, the sealing surface 33 of the car side 15 is sealed along one side and a portion of two sides thereof by the auxiliary door. An opening is then provided into which the main door 12 may be positioned and closed against. Upon closing the main door 12, the sealing surface 30 of the main door 12 is sealed against the sealing surface 32*a* of the auxiliary door 14 and along one sealing surface 33*a* and a portion of the sealing surfaces 33*b* of the car 10.

As is well understood in the art, rotation of the pipes 16 will cause a corresponding rotation of the cranks 18*b* to sequentially draw the doors 12, 14 laterally from the door opening 11 in a sequence as will hereinafter be described. An operating mechanism, indicated generally by the reference numeral 36 is provided on each of the doors 12, 14 for controlling the rotation of the pipes 16 and the cranks 18*b*. The operating mechanism 36 includes a shaft 38 which is rotatably supported on the door. Activating means 40 in the form of a handle are secured to the shaft. A transmission means, generally indicated at 42, and of any known construction is provided and is supported on each of the doors, 12, 14. The transmission means 42 interconnects the operating mechanism 36 with the pipes 16 and cranks 18*b*. Upon rotation of the shaft 38 by the activating means 40, the transmission means 42 imparts a corresponding rotation to the pipes 16 and cranks 18*b* to provide selective lateral movement of the door into and out of the opening 11 in the side 15 of the railway car 10.

Figure 2:
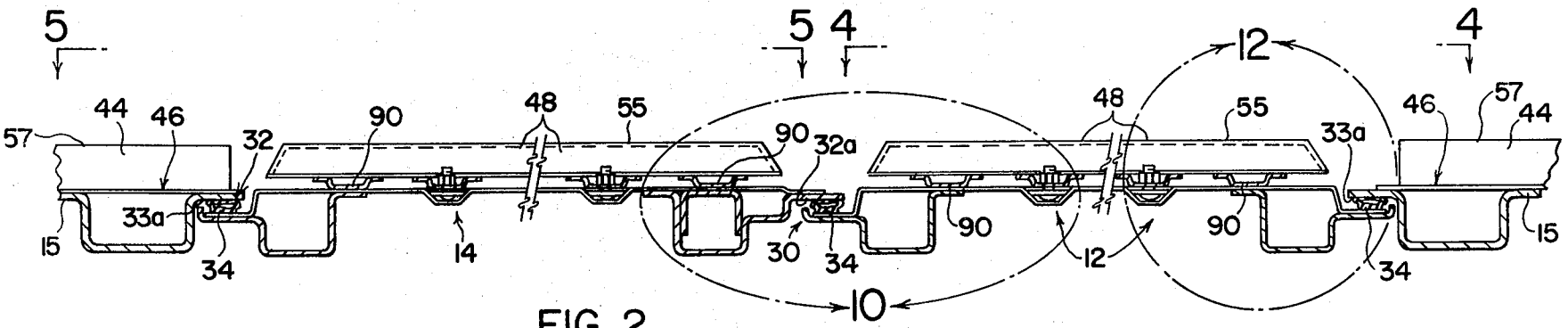
FIG. 2 is a sectional view of the main and auxiliary railway car doors shown in FIG. 1 and taken along the line 2—2 thereof.
Figure 3:
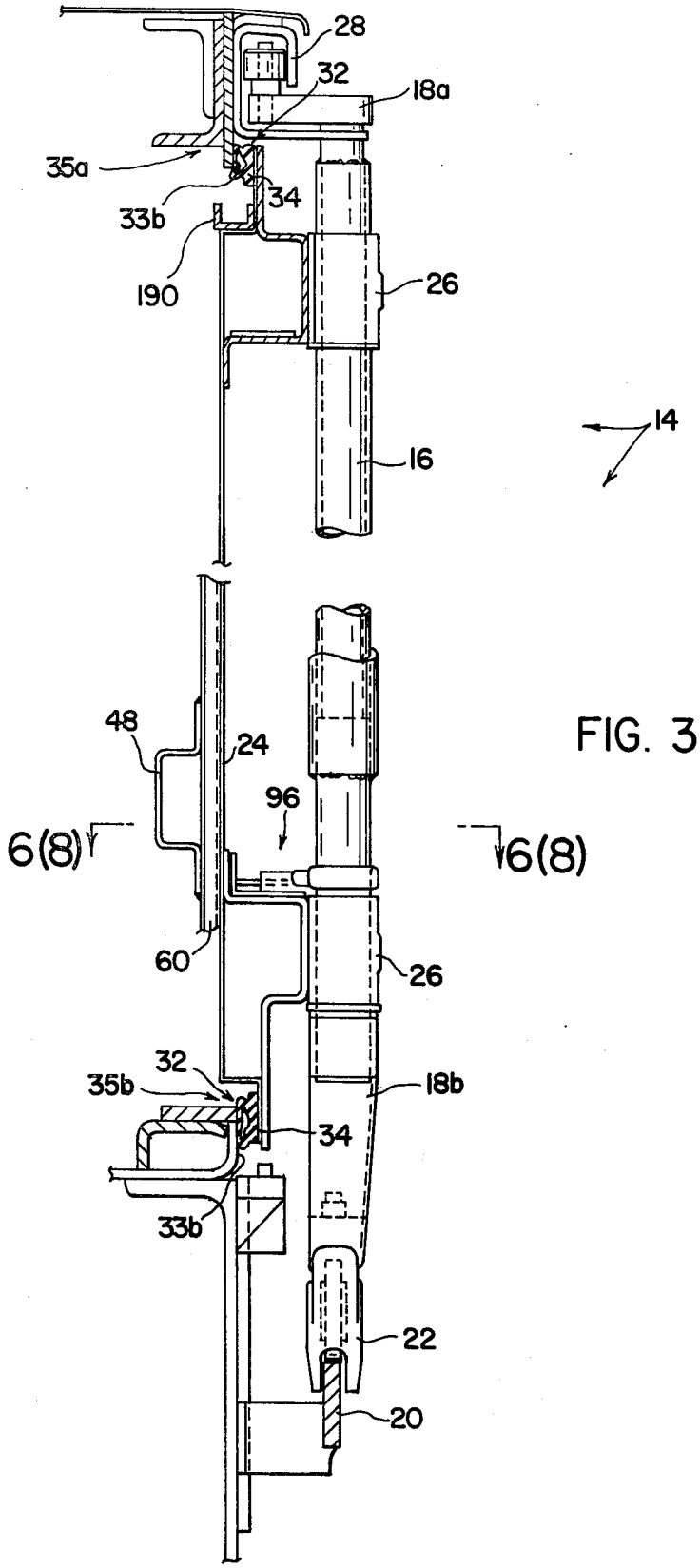
FIG. 3 is a side elevational view of one of the railway car doors shown in FIG. 1 and taken along the line 3—3 thereof.

The railway car 10 is equipped to have internally projecting cargo or lading restraining members, schematically indicated at 44 in FIG. 2. These lading restraining members 44 are selectively attached and removed from the inside, indicated at 46, of the railway car side walls 15 adjacent the opening 11 in any known manner.

When the lading restraining members 44 are secured to the sides 15, filler members or rub rails 48 are removably attached to the inside surface 72 of each of the doors 12, 14. The rub rails or filler members 48 project into the interior of the railway car 10 by an amount substantially equal to the internal projection of the lading restraining members 44 as seen in FIG. 2. The rub rails 48 effectively reduce the distance between the railway car doors 12, 14 and their opposing side or door to the same distance between the cargo restraining members 44 secured to the opposing sides 15 of the railway car 10 to thereby restrain the cargo loaded on the railway car adjacent to the railway car doors 12, 14.

On the other hand, when the cargo restraining members 44 are removed, the effective cargo distance between the opposing sides of the railway car 10 is increased. The rub rails 48 are then also removed from the doors 12, 14 so that the distance between the opposing sides 15 of the railway car 10 is substantially the same as the distance between the railway car doors 12, 14 and their opposing side or door. Thereby the space in which cargo may be carried is uniformly increased.

Figure 4:
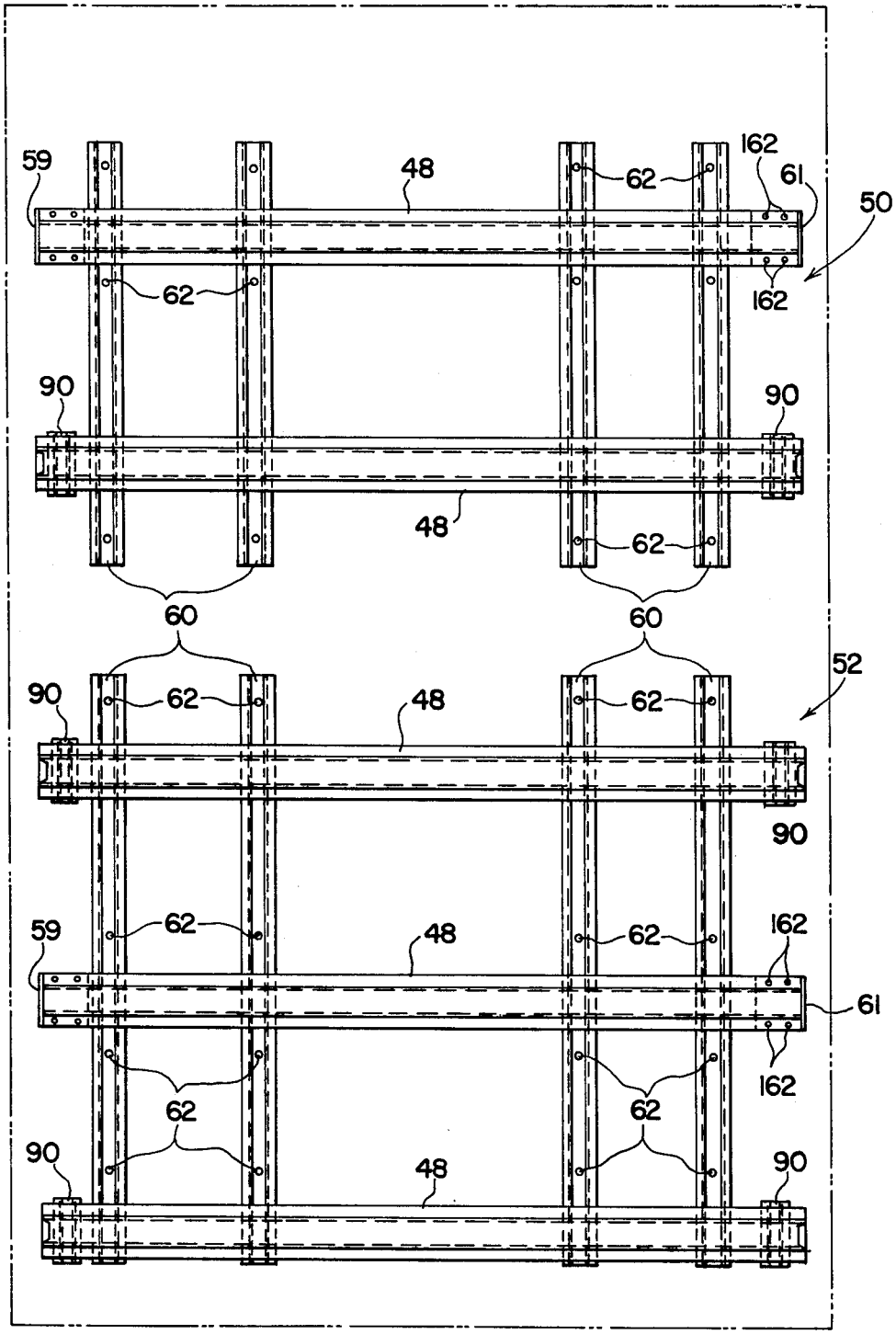
FIG. 4 is a rear elevational view of the main railway car shown in FIG. 2 and taken along line 4—4 thereof.
Figure 5:
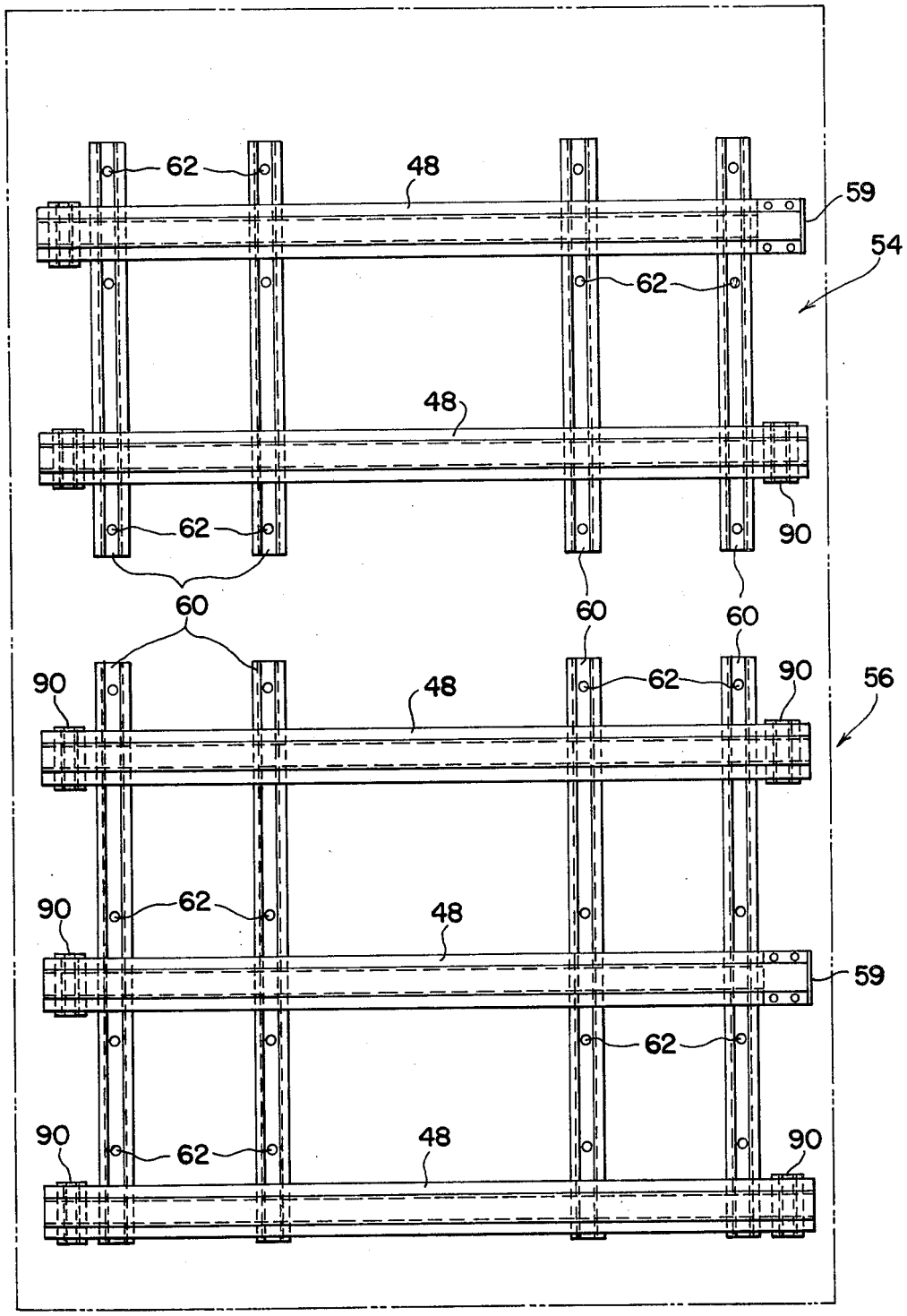
FIG. 5 is a rear elevational view of the auxiliary railway car door shown in FIG. 2 and taken along line 5—5 thereof.

To mount the rub rails 48 on the doors, 12, 14, the rub rails are mounted in grids, which grids may be attached or removed from the doors as will be hereinafter described. Each of the doors has an upper and lower rub rail or filler member grid removably attached thereto. FIG. 4 shows an upper rub rail grid 50 for attachment to an upper portion of the main door 12 and a lower rub rail grid 52 for attachment to a lower of the main door 12. FIG. 5 shows an upper rub rail grid, generally indicatd at 54, and a lower rub rail grid, generally indicated at 56, for attachment to upper and lower portions, respectively, of the auxiliary door 14. It should be understood that the rub rail grids 50, 52, 54, and 56 are constructed so that when they are secured to the inside of their respective doors 12, 14, the inner surfaces 55 thereof are in substantially the same plane as the inner surfaces 57 of the lading restraining 44 as indicated in FIG. 2.

For ease of description, the attachment of the lower rub rail grid 52 to the lower portion of the main door 12 will be hereinafter described. It should be understood that the other grids 50, 54, and 56 are attached to their respective portions of the doors 12, 14 as will be described in connection with the lower main door grid 52.

Figure 12:
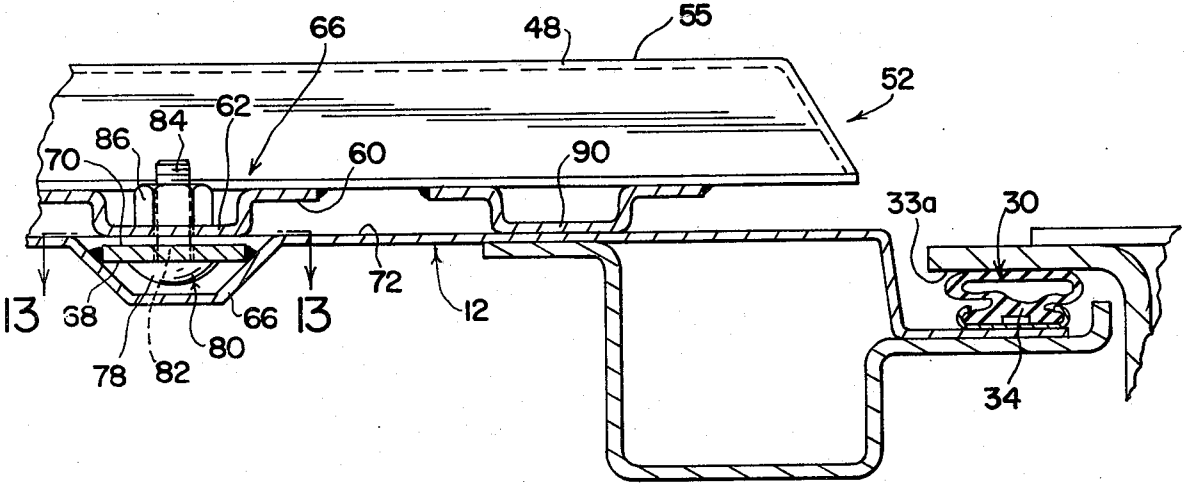
FIG. 12 is an enlarged view of a portion of the railway car door shown in FIG. 2 in the area indicated by 12—12.

The lower main door grid 52 has three rub rails spaced as shown in FIG. 4. The rub rails 46 thereof are substantially parallel to each other and are inter-connected to each other by vertical rub rail stiles 60 disposed at right angles to the rub rails. The vertical rub rail stiles 60 are secured to the rub rails 48 in any conventional manner such as welding. The vertical rub rail stiles 60 are of a hat-shaped cross-sectional configuration as shown in FIG. 12. The rub rails 48 are also of a generally hat-shaped cross-sectional configuration with their ends closed as shown by dotted lines in FIG. 12. Certain other ends of the rub rails have support portions 90 and stop reinforcement portions 59 and 61 shown in FIG. 4 secured thereto as will be hereinafter described.

The vertical rub rail stiles 60 are adapted to be removably secured to the door 12 and thereby secure in position the rub rails 48 to the main door 12. To effect securement of the grid system 52 to the door 12, apertures 62 are provided in the bottom of the hat-shaped portion of the vertical rub rail stiles 60 as seen in FIGS. 4 and 12. These apertures 62 are adapted to receive threaded fasteners 80 therein, which fasteners are secured to the door 12 to thereby secure the rub rail grid system 52 to the door 12.

Figure 13:
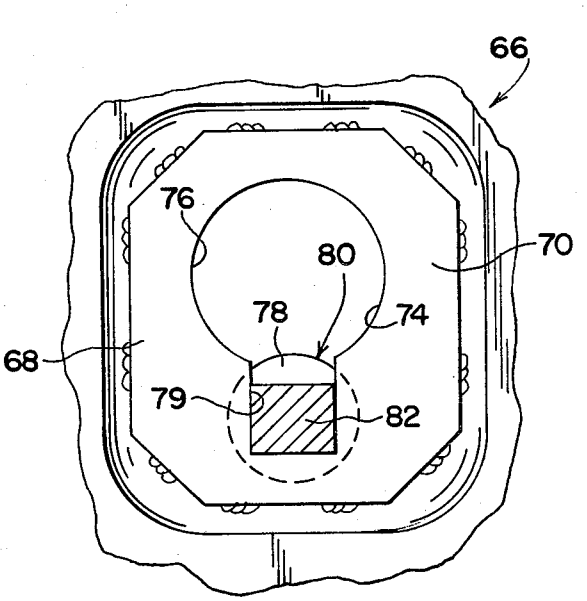
FIG. 13 is an elevational view of a portion of the railway car door shown in FIG. 12 as seen along line 13—13.

The main door 12 has a series of pockets 66, as seen in FIGS. 1, 12, and 13, formed therein. These pockets are formed in a configuration which matches the position of the apertures 62 in the vertical rub rail stiles 60 in the rub rail grid 52 so that the grid 52 may be appropriately positioned and secured to the door 12 as herein described. A retaining member 68 as seen in FIGS. 12 and 13 is secured in the interior of the pocket 66 by any conventional means such as welding so that the outer surface 70 thereof is flush with the inner surface 72 of the door 12 or recessed in the pockets 66.

The retaining member 68 has a key slot shaped opening 74 therein which includes a generally circular portion 76 therein large enough to receive the head 78 of the carriage bolt 80. Thus, the head of the carriage bolt 80 may be inserted into the pocket 66 through the circular portion 76 of the opening 74 and move downwardly into a generally rectangular portion 79 of the opening 74. Thus, the square shoulder 82 on the carriage bolt 80 is non-rotatably received in the generally rectangular opening portion 79. The threaded portion 84 of the carriage bolt 80 extends inwardly of the inner surface 72 of the door 12, and is received in the apertures 62 on the vertical rub rail stiles 60.

Conventional threaded fasteners 86 are used to secure the vertical rub rail stiles 60 to the door 12 by threadedly engaging the threaded portion 84 of the fastener 80. Attached to the extreme ends of certain rub rails 48 as seen in FIGS. 4 and 5 are rub rail end support plates 90 which further support those rub rails on the extreme ends thereof. Certain other ends of the rub rails have stop reinforcement portions 59 and 61 as will be hereinafter described.

When it is desirable to remove the rub rail grid 52 from the door 12, the threaded fasteners 86 securing the rub rail grid 52 to the door 12 are removed by using standard wrenches. The carriage bolts 80 are then removed from the pockets 66 through the generally circular opening portion 76 to thereby render the interior surface of the door 12 smooth and substantially coplanar with the interior side 46 of the railway car side 15.

Figure 6:
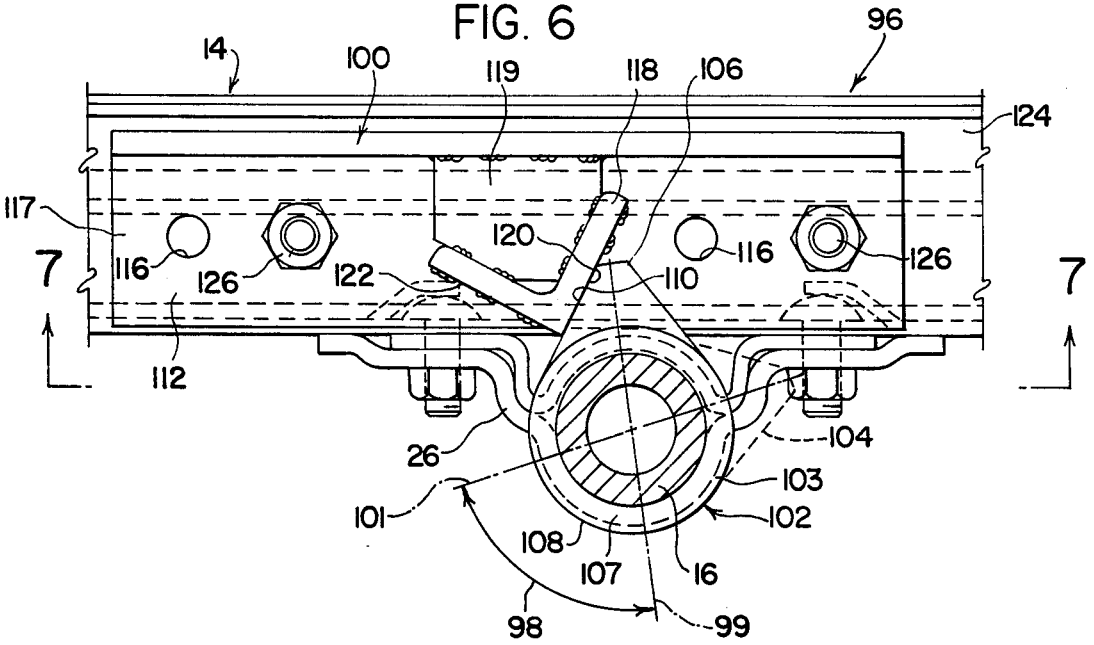
FIG. 6 is a sectional view of a portion of the railway car door shown in FIG. 3 and taken along line 6—6 thereof.

Means, generally indicated at 96 in FIG. 6 are provided for selectively increasing or decreasing the possible amount of rotation of the pipes 16 and cranks 18*b*. When the filler members or rub rails 48 are attached to the inside of the doors 12, 14, the pipes 16 and cranks 18*b* can move a first, greater rotational distance to consequently move the doors laterally out of the opening a first, greater distance and thereby permit the rub rails 48 to clear the side wall 15 of the railway car 10. On the other hand, when the filler members 48 are removed, the cranks 18*b* and pipes 16 are permitted to rotationally move a second, lesser distance laterally out of the opening 11 and clear the side wall 15 of the railway car 10.

Figure 7:
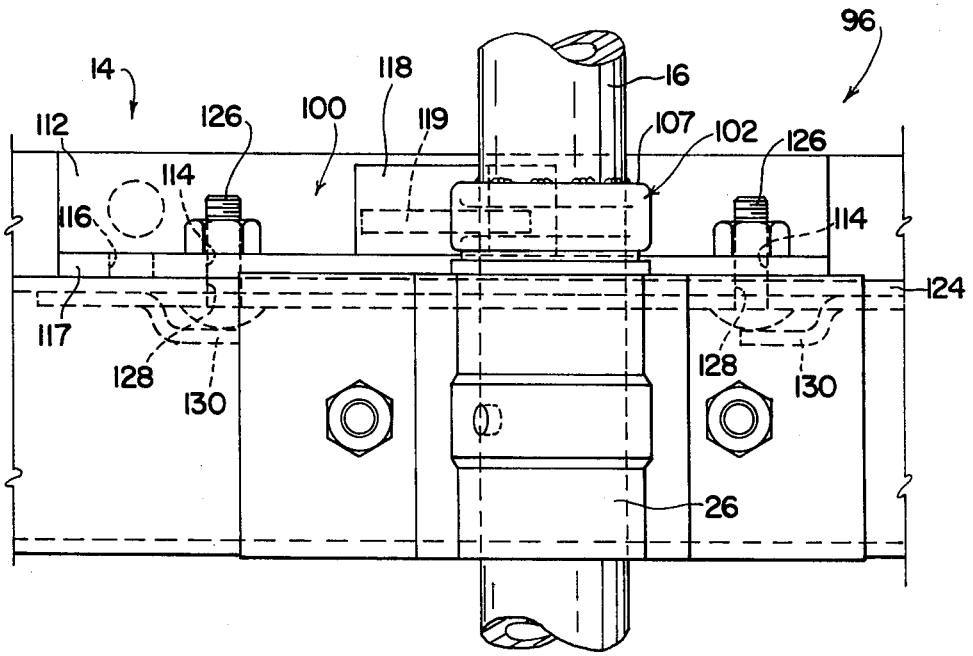
FIG. 7 is a sectional view of the portion of the railway car door shown in FIG. 6 and taken along line 7—7 thereof.

FIGS. 6 and 7 generally show the positioning of the means 96 when it is desirable for the door 14 to move laterally out of the opening a first, greater distance as indicated by the arcuate rotational distance 98 of the pipe 16 to consequently permit the rub rails 48 to clear the side walls 15 of the railway car 10 as herein described.

For ease of description, the means 96 for controlling the amount of lateral movement of the doors 12, 14 will hereinafter be described in connection with the pipes 16 and cranks 18*b* on the right hand side of the auxiliary door 14 shown in FIG. 1. It should be understood, though, that similar means 96 is provided in connection with each and every pipe 16 and crank 18*b* assembly on both the main 12 and auxiliary door 14 and is positioned as described herein.

The means 96 for controlling the lateral movement of the auxiliary door 14 includes a door mounted pipe stop member 100 secured to the door 14 and a pipe stop member 102 secured to the pipe 16 as seen in FIGS. 6 and 7.

As the pipe 16 is moved in a clockwise direction, the door 14 is moved laterally into the opening 11 in the car 10. As such clockwise movement continues, the gasket 34 is compressed and the auxiliary door 14 is positioned in a sealing engagement with a portion of the opening 11 as hereinabove described. No stop means are provided to prohibit travel of the pipe 16 in the clockwise direction since the gasket 34 must be properly compressed. In this closed position, the pipe stop member 102 is shown in the dashed line position 104 in FIG. 7 with its arcuate position indicated by line 101.

It should be noted that as pointed out hereinabove, rotation of the pipes 16 and corresponding rotation of the cranks 18*b* imparts lateral movement to the door 14 into and out of the opening 11. It should further be understood that the direction of rotation of the pipe 16 to impart a corresponding lateral movement to the door is dependant on the angular position of the crank 18*b* which is attached to its end. If the crank 18*b*, as illustrated in FIG. 1 in connection with the pipe 16 shown in FIG. 6, is positioned as shown in FIG. 1, the door 14 will close upon clockwise rotation as viewed in FIG. 6. If the crank position were reversed so that the crank 18*b* extended to the left side of the pipe 16 as viewed in FIG. 1, counter-clockwise rotation would operate to close the door 14 and clockwise rotation would operate to open the door.

When it is desirable to open the door from its closed position, the pipe 16, as shown in FIG. 6, is rotated in a counter-clockwise direction. As the pipe 16 is rotated in a counter-clockwise direction, the pipe stop member 102 has an extending portion 106 which arcuately moves into contact with the door mounted pipe stop member 100 and stops further movement of the pipe 16 and consequently, the door 14.

The pipe stop member 102 has a hub portion 107 which is generally circular in cross-section as seen in FIGS. 6 and 7. The hub portion 103 of the pipe stop member 102 is secured to the pipe 16 by any appropriate means such as welding. The extending portion 106 extends from the outer circular surface 108 of the collar 107 of the pipe stop member 102 and has a pipe stop engaging surface 110 for engaging the door mounted pipe stop member 100.

The door mounted pipe stop member 100 has an angle shaped base portion 112 having a first pair of openings 114 and a second pair of openings 116 on the lower portion 117 of the base portion 112. Each of the pairs of openings 114, 116 are collinear with each other. The door mounted pipe stop member 100 also has a stop portion 118 secured to the lower base portion 117. A reinforcement 119 is provided to further strengthen the stop portion 118 and is inter-connected between portions 118 and 112.

The stop portion 118 has a first stop surface 120 which is at a first angle with respect to a line inter-connecting the pairs of openings 114 and 116 and a second stop surface 122 which is at a second angle with respect to a line inter-connecting the pairs of openings 114 and 116. The first and second stop surfaces 120 and 122 allow movement of the doors 12, 14 a first, greater distance and a second, lesser distance laterally from the opening 11 as will be hereinafter described. It should be understood that the door mounted pipe stop member 100 is a weldment as shown in this embodiment but it should be understood that it may be of any other design.

The door mounted pipe stop member 100 is secured to the bottom edge member 124 of the door 14 by means of threaded fasteners 126 positioned in apertures 128 in the bottom edge member 124. The threaded fasteners 126 are retained in the openings 128 by means of a lip portion 130 formed in the bottom edge member 124, as seen in FIG. 7. The threaded fasteners 126 extend through the pair of apertures 114 in the door mounted pipe stop member 100 to allow the pipe to move the first, greater arcuate distance 98.

The pipe 16 continues to rotate in a counter-clockwise fashion from the closed position, indicated by position 104 of the pipe stop member 102, and the door 14 continues to move laterally out of the opening 11 until the stop surface 110 on the extending portion 106 of the pipe stop member 102 engages the stop surface 120 on the door mounted stop member 100.

In this position, the further outward movement of the door 14 is prohibited and the door 14 is then free to move laterally in a direction away from the main door 12 and longitudinally along the side 15 of the railway car 10.

When the rub rail grids 50, 52, 54, and 56 are removed from the doors 12, 14, it is not necessary for the doors 12, 14 to move as great a distance laterally out of the opening 11 in order to clear side wall 15 of the car 10. Since the lateral movement of the doors 12, 14 is dependant on the amount of rotation of the pipes 16 and cranks **18*b*, it should be understood that when the pipe 16 is moved from the closed position 101, as seen in FIG. 8, to the open position, indicated by position line 138, the door 14** is moved a corresponding second, lesser distance laterally out of the opening.

In order to stop the extending portion 106 of the pipe stop member 102 so that it stops at its arcuate position 138, the door mounted pipe stop members 100 on the door 14 are removed by using standard wrenches and re-positioned so that the stop surface 110 of the extending portion 106 of the pipe stop member 102 is in contact with the second stop surface 122 when in the arcuate position 138. To so re-position the door mounted pipe stop members 100, it should be understood that a door mounted pipe stop member 100 is provided in cooperation with each of the pipes 16 on both the right and left hand sides of the doors, 12, 14. The crank **18*b* used in conjunction with the left hand pipe 16 extends to the left of that pipe. Accordingly, to open the door 14, the direction of rotation of the right hand pipe 16 is opposite to the direction of rotation of the left pipe. It should be noted that the same is true in case of closing the door 14 and the same movements are necessary for the opening and closing of the main door 12**.

Figure 8:
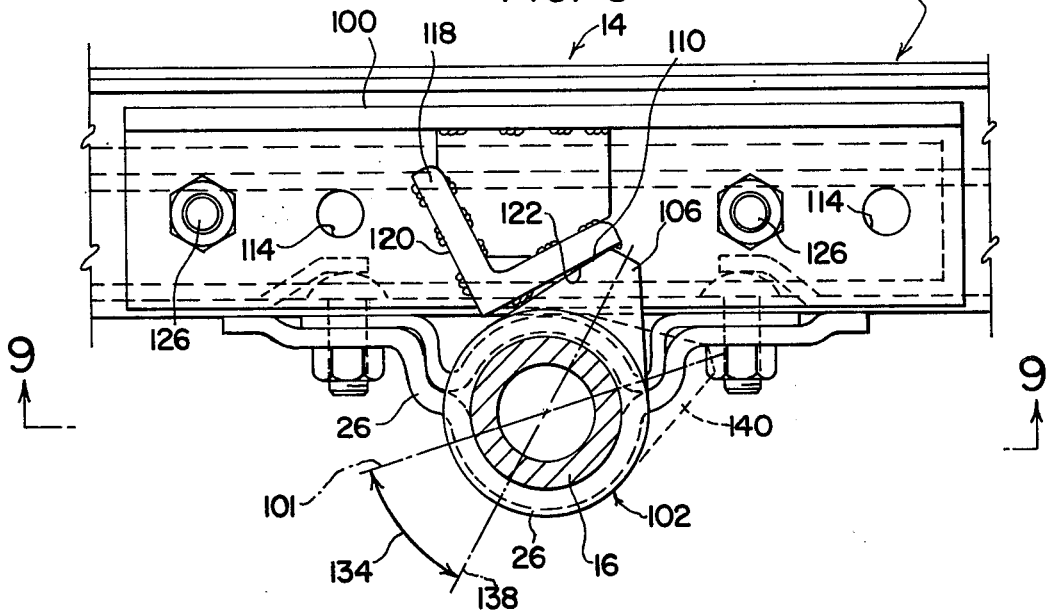
FIG. 8 is a sectional view of a portion of the railway car door shown in FIG. 3 and taken along line 8—8 thereof.
Figure 9:
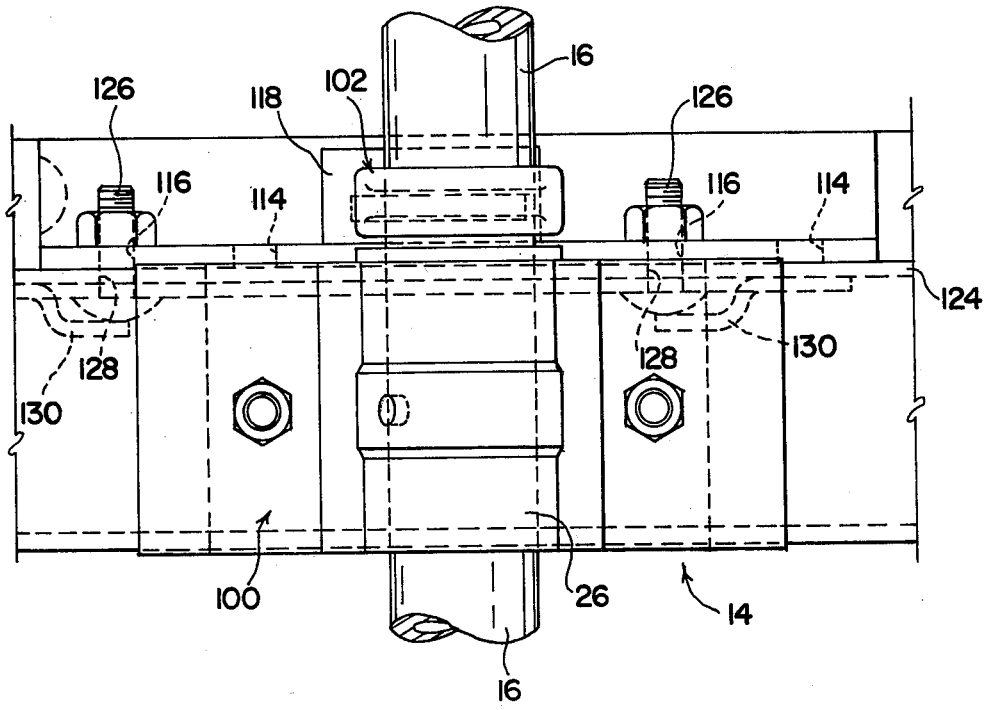
FIG. 9 is a side elevational view of the portion of the railway car door shown in FIG. 8 and taken along line 9—9 thereof.

Accordingly, to stop the stop member 102 in its second, lesser arcuate position 138, as seen in FIG. 8, the door mounted pipe stop member 100, used in conjunction with the right hand pipe 16 on the door as shown in FIG. 6, is moved for use in conjunction with the left hand pipe 16 on the left hand and the door mounted pipe stop member 100 used in conjunction with the left hand pipe 16 is moved to be used in conjunction with the right hand pipe 16 as seen in FIGS. 8 and 9. The pair of openings 116 in the door mounted pipe stop member 100 are aligned with the openings 128 in the bottom edge member 124 of the door 14 and the door mounted pipe stop member 100 is secured thereto by means of the threaded fasteners 126.

When the door mounted pipe stop member is in the position shown in FIGS. 8 and 9, the second stop surface 122 is properly positioned to stop the extending portion 106 of the pipe stop member 100 in the position indicated by line 138. Accordingly, the door 14 is able to move a second, lesser distance which is sufficient for the door 14 to clear the side wall 15 of the car when the rub rail grids 54, 56 are not attached thereto. It should be understood that in a like manner, the door mounted pipe stop members 100 used in conjunction with the pipes 16 on the main door 12 may be similarly re-positioned to allow the door 12 to move a second, lesser distance laterally out of opening 11.

As described above, due to the gasket configuration on the doors 12, 14, it is necessary for the main door 12 to be first laterally moved out of opening 11 before the auxiliary door 14 may be removed from the opening 11. The auxiliary door 14 is then moved laterally out of the opening 11 and is then free to move longitudinally along the side 15 of the railway car 10 in a direction away from the main door 12.

When it is desirable to have the rub rails 48 attached to the main and auxiliary doors 12, 14, it is necessary for the doors to move a first, greater distance out of the opening 11. As described above, such movement is provided by the angular movement of the pipe 16 through the arcuate distance 98 to correspondingly move the door from a closed position and the position of the extending portion 106 of the pipe stop member 102 as shown in FIG. 6, from an arcuate position is indicated by the line 101 to an open position represented by the arcuate position line 99.

Figure 10:
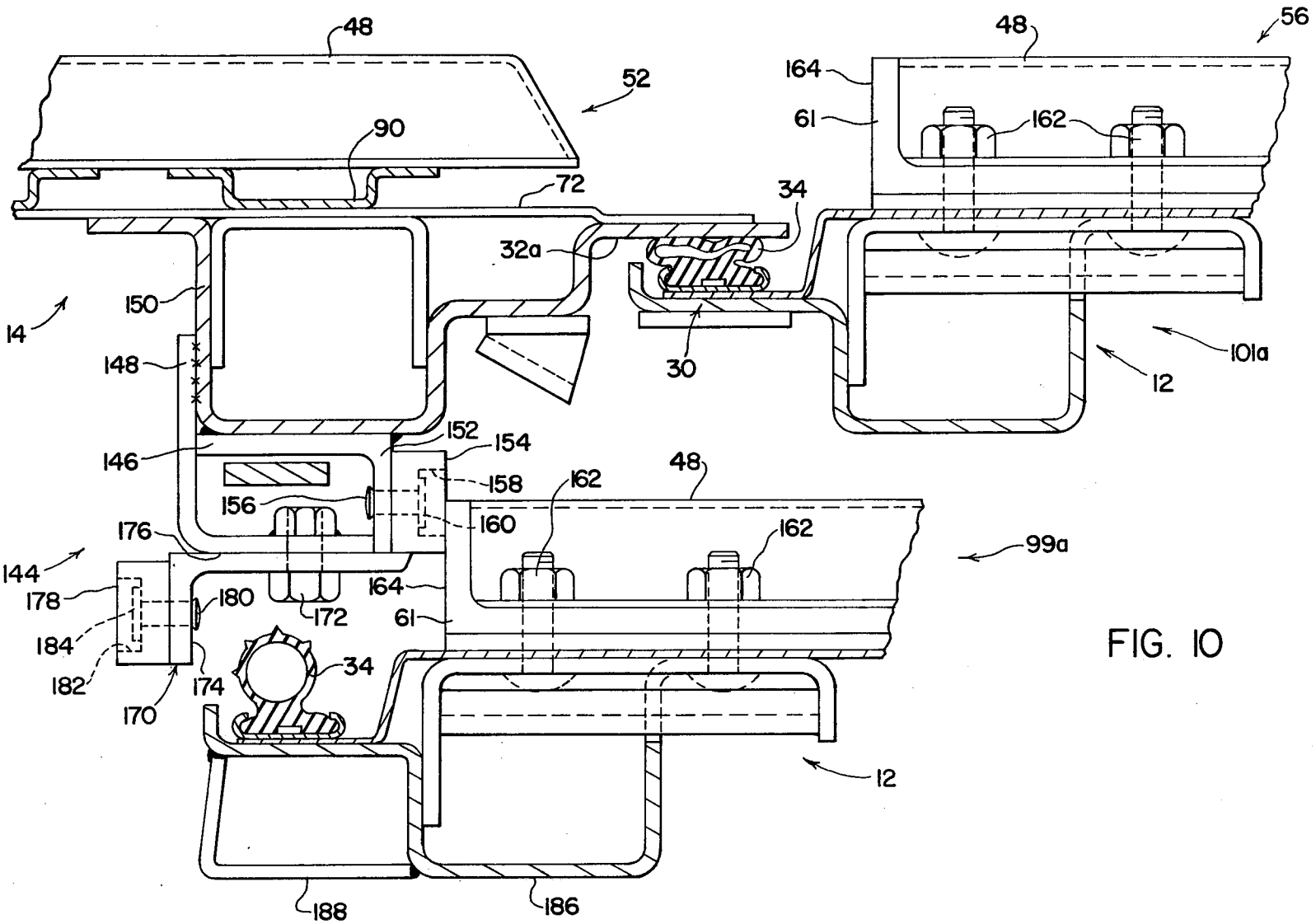
FIG. 10 is an expanded view of the portion of the railway car door indicated at 10—10 in FIG. 2 showing rub rails mounted thereon.
Figure 11:
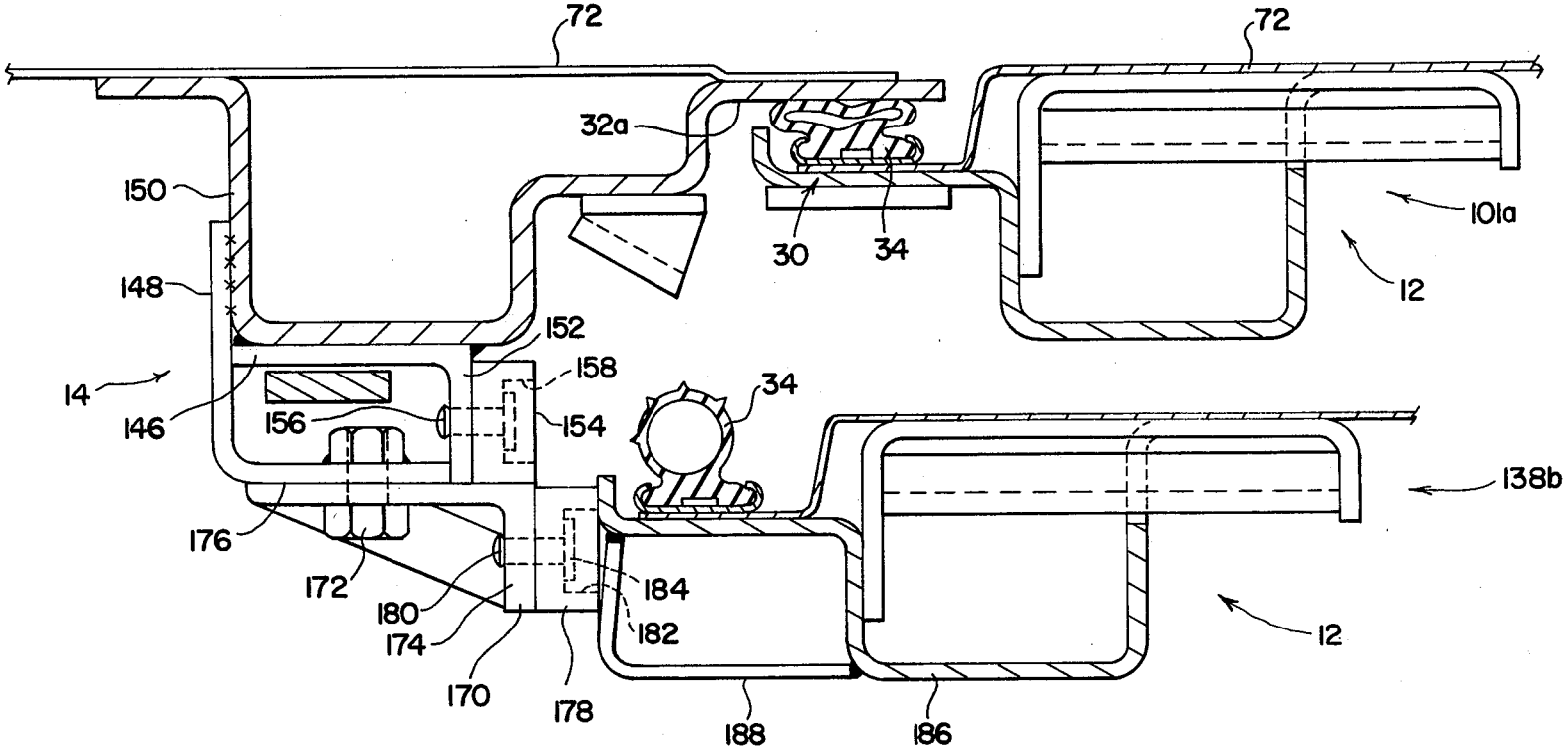
FIG. 11 is the portion of the railway car door shown in FIG. 10 with rub rails removed.

The movement of the pipe 16 on the main door 12 through such an arcuate distance 98, moves the main door 12, from a position indicated at **101*a* shown in FIG. 10, laterally outward of the opening to an open position indicated at 99*a*. When the main door 12 is in the outward position 99*a*, it is free to move along the car and clear the car side 15. On the other hand, when the filler members 48 are removed from the car doors 12, 14, it is desirable to move the car doors a lesser distance laterally out of the opening 11. As described hereinabove, the car doors are moved a lesser distance laterally out of the opening 11 from the closed position 101*a* to an open position 138*b* as shown in FIG. 11 wherein the open position 138*b* corresponds with the rotational limit line 138 on the movement of the pipe 16 as shown in FIG. 8**.

When the main door 12 is laterally moved out of the opening 11, it is desirable to provide stop means, generally indicated at 144 in FIG. 10 to limit movement of the main door 12 along the car 10 towards the auxiliary door 14 since if such movement is not limited, the main and auxiliary doors 12, 14 respectively, may impact each other and the doors 12, 14 become damaged thereby. In fact, it is possible for the sealing surfaces **30, 32*a* of the doors 12, 14 to be damaged thereby rendering the seal between the doors 12, 14 ineffective if not inoperable. The stop means 144, also positions the main door 12 adjacent the portion of the opening 11 covered by the main door when in the closed position. When the main door 12 is so positioned by the stop means 144, it may be moved laterally into the opening 11** to its closed position.

After the main door 12 is moved out of the opening 11, the auxiliary door 14 may be moved laterally out of the opening 11 and then longitudinally along the side of the railway car in a direction away from the main door 12 to thereby open the opening 11 and allow cargo to be loaded into the car 10.

The lateral movement of the doors 12, 14 is variable depending upon whether or not the rub rails 48 are attached thereto. The stop means 144 is adjustable to limit impacting of the main door 12 with the auxiliary door 14 and to compensate upon adjustment thereof for the distance by which the main door 12 is moved out of the opening 11. The adjustable door stop means 144 is adjustable to so limit impacting of the main door 12 with the auxiliary door 12 whether it is moved the first, greater distance from position **101*a* to 99*a*, or the second, lesser distance from position 101*a* to position 138*b***.

The adjustable door stop means 144 is mounted on a front edge of the auxiliary door 14 and includes a base stop support member 146 and a front edge auxiliary stop support member 148 each of which are inter-connected with each other and the front edge support member 150 of the auxiliary door 14 by any suitable means such as welding. The base stop support member 146 has portion 152 extending from the surface of the front edge support member 150 of the door 14. The extending portion 152 has a first stop member 154 secured thereto by any conventional means such as a rivet 156. The first stop member 154 has a depression for 158 for receiving the head 160 of the rivet 156 and thereby protect the rivet from damage by impact with the main door 12 as will be described.

The first stop member 154 if positioned laterally away from the auxiliary door 14 so to prevent damage by impacting of the main door 12 with the auxiliary door 14 when the main door 12 is in the position 99*a*, corresponding with the angular position line 99, which is the first, greater distance away from the sealing position 101*a*.

The first stop member 154 and the members 146, 148 to which it is attached is positioned on the front edge support member 150 of the auxiliary door 14 so that it co-acts with the main door 12 to contact the reinforcing member 61 on the main door as shown in FIGS. 4 and 10. The reinforcing member 61 is located at the ends of two rub rails 48 as shown in FIG. 4 and secured to the door 12 by any conventional means such as the fasteners 162. When the main door is moved to position 99*a* as shown in FIG. 10, the front edge 164 of the reinforcing member 61 contacts the first stop member 154 to thereby prevent damage by impact between the doors 12, 14.

It should be understood that there are two such adjustable door stop means 144 which are positioned on the auxiliary door 14 along the reinforcing member 150 to co-act with both stop members 61 shown in FIG. 4.

The main door 12 is then free to move along the side 15 of the car 10 in a direction away from the auxiliary door 14 until the reinforcing members 59 on the opposite ends of the rub rails 48 contact car mounted end stop members, not shown in the drawings. These end stop members are secured to the railway car door 15 and stop further movement of the main door 12 along the side 15 and away from the auxiliary door 14 yet allowing sufficient movement to open the portion of the opening 11 in the side of the car 10 which is closed by the main door 12.

A second door support member 70 is secured to the front edge auxiliary stop member 148 by means of a conventional fastener device 172. The second door stop support member 170 has a portion 174 which extends from the outer surface 176 of the front edge auxiliary stop support member 148 and the first stop member 154 in the direction laterally away from the auxiliary door 14. The extending portion 174 has a second stop member 178 attached thereto by a rivet 180. The second stop member 178 has a recess 182 therein for protecting the head 184 of the rivet 180.

When the rub rails 48 are attached to the doors 12, 14 and the door 12 is moved a distance from position 101*a* to 99*a* as shown in FIG. 10, the second stop member 178 is in a position shown therein which is ineffectual to stop the door 12 from impacting with the auxiliary door 14. When the rub rails 48 are removed from the door 12, the distance which the door 12 is permitted to move is from position 101*a*, the closed position, to a second, lesser distance to position 138*b* shown in FIG. 11. The second door stop support member 170 is re-positioned by use of standard wrenches on the fastener means 172 so that the second stop member 178 contacts the door 12 as will be hereinafter described. This adjustment is performed by loosening the conventional threaded fastener means 172 and rotating or "inverting" the second door stop support member 170 so that the second stop member 178 extends from the first stop member 154 towards the main door 12 as shown in FIG. 11. In this position, the second stop member 178 is positioned laterally away from the first stop member 154 and door 14.

When the main door 12 is moved to the position 138*b* and the stop member 170 is "inverted" to the position shown in FIG. 11 with respect to its position shown in FIG. 10, and the main door 12 is moved laterally towards the adjacent, auxiliary door 14, the second stop member 178 contacts the front edge member 186 and front edge reinforcement member 188 of the main door 12 to thereby limit further movement of the main door 12 towards the auxiliary door 14. By so limiting such movement, the doors 12, 14 are not damaged by impact with each other, while the main door 12 is free to move away from the auxiliary door 14 and along the car door side 15 to its extreme end position in the extreme end position, the end stop member secured to the car door side 15 contacts the main door 12 and stops further movement thereof while allowing sufficient movement of the main door to open the portion of the opening 11 closed by the main door.

The auxiliary door 14 is then moved laterally out of the opening a second, lesser distance corresponding to the distance between the position of the main door 101*a* and position 138*b* so that it clears the side 15 of the car 10 and is then moved along and adjacent to the side 15 of the car 10 in a direction away from the main door 12. The auxiliary door is stopped in an extreme end position by end stop members secured to the side 15 of the car 10 similarly as described in connection with the main door 12 thereupon leaving the opening 11 to allow cargo to be loaded or unloaded into the car 10.

In certain cases, there is water seepage between the sealing surfaces 30, 32, and 33 between the opening 11 and the main auxiliary doors 12, 14 respectively. Such seepage may arise as the result of damage to the gasket 34 or damage to the gasket seating surfaces. To avoid water from seeping into the cargo carrying space of the car 10 and avoid possible damage to the cargo thereby, a water gutter 190 is provided to catch such water seepage. As shown in FIG. 3, the water gutter 190 is secured to the door 14 along the upper edge thereof and adjacent to the sealing surface 32 and 33 respectively. The water gutter member 190 is generally channel or "U" shaped in configuration so that the water is caught and held in the bottom of the "U" shaped member. The channel member 190 extends along the length of the car door 14 and is perforated at one end thereof to allow water to drain into a vertical door edge member and hence away from the interior of the car 10. It should be understood that a water gutter is likewise provided on the main door 12.

Having described the invention, we claim:

1. In a railway car door of the type including a pair of pipes and cranks rotatably secured to the door, an operating mechanism for rotating said pipes and cranks including a shaft rotatably supported on said door, activating means secured on said shaft and transmission means supported on said door inter-connecting said operating mechanism with said pipes and cranks whereby rotation of said shaft in response to operation of said activating means imparts corresponding rotation to said pipes and cranks and selective lateral movement of said door into and out of an opening in the side of said railway car, said car being equipped to have internally projecting lading restraining members selectively attached and removed from the inside of the railway car side wall adjacent said opening, and filler members removably attached to the inside of said door, said filler members project into said car by an amount substantially equal to the internal projection of said lading restraining members, the improvement comprising:

means for selectively increasing and decreasing the amount of rotation of said pipes and cranks possible such that when said filler members are attached to the inside of said door, said pipes and cranks can move a greater rotational distance to move said door laterally out of said opening a first, greater distance to permit said filler members to clear said side wall; and, when said filler members are removed, said cranks and pipes are permitted to rotationally move a lesser distance which is sufficient for said door without said filler members attached thereto to move a second, lesser distance laterally out of said opening and to clear said side wall.

2. In a railway car door as described in claim 1, the improvement wherein said means for selectively increasing or decreasing the possible amount of rotation of said pipes and cranks includes a pipe stop member mounted and secured to one of said pipes and a door mounted pipe stop member mounted and secured to said door, one of said pipe stop members selectively securable to the respective member on which it is mounted and secured in a first position in which said pipes and cranks can move a greater rotational distance to move said door laterally out of said opening a first, greater distance and thereby permit said filler members to clear said side wall, and, a second position in which said pipes and cranks can move a lesser rotational distance to move said door laterally out of said opening a second, lesser distance which is sufficient for the inner surface of said door to clear said side wall.

3. In a railway car door as described in claim 2, the improvement including threaded fasteners for securing said one pipe stop member to the respective member on which it is mounted and secured, thereby allowing standard wrenches to be used in changing the securement of said one pipe stop member between a first and second position.

4. In a railway car door as described in claim 1, the improvement including adjustable door stop means for positioning said door and for protecting said door and a second, adjacent railway car door adjacent to said door from damage from impact with each other, said door and adjacent door in combination providing means for opening and closing said opening, said adjustable door stop means including an adjustable door stop member selectively secured to said door in a first position to limit movement of the second, adjacent door in a direction along said side wall and toward said door when the second, adjacent door is moved laterally out of said opening a first, greater distance to permit said filler members to clear said side wall and to allow movement of said second, adjacent door along the side wall in a direction away from said one door; and in a second position, to limit movement to the second, adjacent door in a direction along the side wall and toward said one door when said second, adjacent door is moved laterally out of said opening a lesser distance which is sufficient for said second, adjacent door without said filler members attached thereto to clear said side wall and to allow movement of the second, adjacent door along the side wall in a direction away from said door.

5. In a railway car door as described in claim 1, the improvement including a water gutter member, said door having at least one sealing surface for sealing against the railway car side wall adjacent to said opening therein, said water gutter member secured to said door to drain seepage through said one sealing surface away from the interior of the railway car.

6. In a railway car having a plurality of doors for selectively opening and closing an opening, said doors being of the type of including a pair of pipes and cranks rotatably secured to the door, an operating mechanism for rotating said pipes means secured on said shaft and transmission means supported on said door inter-connecting said operating mechanism with said pipes and cranks whereby rotation of said shaft in response to operation of said activating means imparts corresponding rotation to said pipes and cranks and selective lateral movement of said door into and out of the opening, said car being equipped to have internally projecting lading restraining members selectively attached and removed from inside of the railway car side wall adjacent said opening, and filler members removably attached to the inside of said door, said filler members project into said car by an amount substantially equal to the internal projection of said lading restraining members, the improvement comprising:

means for selectively increasing and decreasing the amount of rotation of said pipes and cranks possible such that when said filler members are attached to the inside of said door, said pipes and cranks can move a greater rotational distance to move said door laterally out of said opening a first, greater distance to permit said filler members to clear said side wall; when said filler members are removed, said cranks and pipes are permitted to rotationally move a lesser distance which is sufficient for said door without said filler members attached thereto to move a second, lesser distance laterally out of said opening and to clear said side wall, and adjustable door stop means for protecting the doors from damage from impact with each other, said doors in combination providing means for opening and closing said opening, said adjustable door stop means including an adjustable stop member selectively secured and mounted on one of said doors in a first position to prohibit movement of second, adjacent door in a direction along said side wall and toward said one door when said second, adjacent door is moved laterally out of said opening a first, greater distance to permit said filler members to clear said side wall and allow movement of said second, adjacent door along the side wall and toward said one door when said second, adjacent door is moved laterally out of said opening a second, lesser distance which is sufficient for the inner surface of said second adjacent door to clear said side wall and move along said side wall in a direction away from said one door.

7. In a railway car as described in claim 6 in which the improvement includes in which said adjustable stop member is in an inverted position when in said first position with respect to its position when in said second position.

* * * * *

UNITED STATES PATENT OFFICE

CERTIFICATE OF CORRECTION

PATENT NO. : 4,064,810

DATED : Dec. 27, 1977

INVENTOR(S) : Oliver James Jenkins et al

It is certified that error appears in the above-identified patent and that said Letters Patent are hereby corrected as shown below:

Column 14, line 14, delete the words "said doors" and insert therefor the words --each door--;

Column 14, line 18, after the word "pipes" insert --including a shaft rotatably supported on said door, activating--;

Signed and Sealed this

*Fourth* Day of *December 1979*

[SEAL]

*Attest:*

SIDNEY A. DIAMOND

*Attesting Officer*

*Commissioner of Patents and Trademarks*